US006832405B1

(12) United States Patent
Miller

(10) Patent No.: US 6,832,405 B1
(45) Date of Patent: Dec. 21, 2004

(54) TWO-SIDED TOILET BRUSH

(76) Inventor: Melinda Miller, 2625 Charbray Dr., Jacksonville, FL (US) 32211

( * ) Notice: Subject to any disclaimer, the term of this patent is extended or adjusted under 35 U.S.C. 154(b) by 0 days.

(21) Appl. No.: 10/689,740

(22) Filed: Oct. 22, 2003

(51) Int. Cl.[7] ..... A47L 13/12
(52) U.S. Cl. ..... 15/114; 15/244.1; 15/160
(58) Field of Search ..... 15/114, 115, 244.1, 15/160

(56) References Cited

U.S. PATENT DOCUMENTS

| | | | | | |
|---|---|---|---|---|---|
| 1,510,898 | A | | 10/1924 | Nikicser | |
| 2,738,529 | A | * | 3/1956 | Bernet | 15/115 |
| 2,879,532 | A | | 3/1959 | Szabo | |
| 3,531,814 | A | | 10/1970 | Safalow | |
| D236,564 | S | | 9/1975 | Kaufman | |
| 4,184,221 | A | * | 1/1980 | Edwards | 15/114 |
| 4,802,782 | A | | 2/1989 | Scalf | |
| 4,961,733 | A | | 10/1990 | Joseph et al. | |
| 4,967,441 | A | | 11/1990 | White | |
| D337,659 | S | | 7/1993 | Lacy | |
| D358,487 | S | | 5/1995 | Kneesch et al. | |
| 5,878,459 | A | | 3/1999 | McParland | |
| 5,960,509 | A | | 10/1999 | Wu | |
| 6,178,581 | B1 | | 1/2001 | Lewis | |
| 6,202,246 | B1 | | 3/2001 | Boucher | |
| 6,289,547 | B1 | | 9/2001 | Narula et al. | |
| 6,438,784 | B1 | * | 8/2002 | Yu | 15/106 |

FOREIGN PATENT DOCUMENTS

| | | |
|---|---|---|
| GB | 241254 | 10/1925 |

* cited by examiner

*Primary Examiner*—Randall Chin
(74) *Attorney, Agent, or Firm*—Richard C. Litman

(57) ABSTRACT

The two-sided toilet brush has a scrub brush head having stiff bristles for loosening accumulated dirt, debris and hard water stains, and a sponge head on the opposite side for wiping away excess dirt or debris inside the toilet bowl and the top and side of the toilet rim element.

11 Claims, 3 Drawing Sheets

TWO-SIDED TOILET BRUSH

BACKGROUND OF THE INVENTION

1. Field of the Invention

The present invention relates generally to cleaning implements. More specifically, the invention is a scrub brush for cleaning toilets having hard bristles and a sponge pad on opposites sides.

2. Description of the Related Art

The related art of interest describes various toilet cleaning utensils, but none describes the present invention. There is a need for a dual purpose cleaning utensil that can scrub and wipe off the scrubbed debris from a toilet bowl. The related art will be discussed in the order of perceived relevance to the present invention.

U.S. Pat. No. 5,878,459 issued on Mar. 9, 1999, to Kelly McParland describes a toilet brush having a cylindrical scrubbing pad portion and a cylindrical bristle brush on the same longitudinal axis and extending from a handle having a flexible connection. The toilet brush is distinguishable for requiring a specific flexible handle and the scrubber and brush on the same longitudinal axis.

U.S. Design Pat. No. 337,659 issued on Jul. 27, 1993, to Danny Lacy describes a combined cleaning brush and sponge attached on opposite sides of a flattened handle having a ribbed bottom and an inclined portion adjacent the cleaning portion. The device is distinguishable for omitting apertures in the brush and sponge portions.

U.S. Pat. No. 2,879,532 issued on Mar. 31, 1959, to Gyozo Szabo et al. describes a utility cleaner and brush device comprising an annular ring base supporting a brush and a hinged sponge pad secured by a cloth sheet having an abrasive coating. A wire handle is attached to the annular ring by a wire clamp. The device is distinguishable for requiring an abrasive cover for the sponge.

U.S. Pat. No. 1,510,898 issued on Oct. 7, 1924, to Francis G. Nikicser describes a combination brush and aligned felt pads on one end of a handle having bristles at its opposite end. The device is distinguishable for requiring an additional brush on the end of the handle and felt pads.

U.S. Pat. No. 4,967,441 issued on Nov. 6, 1990, to Robert A. White describes a toilet bowl brush comprising a wire loop frame, supporting encompassing bristles, and an elongated handle converted temporarily into a steel wool brush by an adaptor spider which embraces the larger dimension of the brush and projects a forwardly and upwardly canted lance upon which a steel wool pad is impaled to enable under-the-rim scrubbing. The device is distinguishable for requiring a lance having a steel wool pad extending from the brush.

U.S. Design Pat. No. 236,564 issued on Sep. 2, 1975, to Jack W. Kaufman describes an ornamental combined brush and sponge for surgical scrubbing comprising a rectangular base with a sponge and brush on opposite sides thereof. The brush bristles are arranged in a longitudinal design with three rows of long bristles having shorter bristles between the rows. The device is distinguishable for requiring distinctive rows of bristles of varying length.

U.S. Design Pat. No. 354,626 issued on Jan. 24, 1995, to Joseph B. Hurwitz describes an ornamental combined brush and sponge applicator having a handle. The sponge overlaps one end of the handle stick. The brush layer overlaps the sponge. The device is distinguishable for requiring the overlapping of a bristle layer over a doubled up sponge layer.

U.S. Design Pat. No. 358,487 issued on May 23, 1995, to Margaret J. Kneesch et al. describes an ornamental combined pad and brush cleaning implement comprising a bristle brush and a sponge pad connected together at a right angle on a long handle. The sponge pad can be lowered by a slidable collar connection on the handle. The implement is distinguishable for requiring a slidable collar connection on the handle for manipulating the sponge pad relative to the brush pad.

U.S. Pat. No. 3,531,814 issued on Oct. 6, 1970, to Harold Safalow describes a toe cleaning device comprising a conically shaped toe cleaning member that is half brush and half sponge mounted on a rod. The device is distinguishable for requiring a conical shaped half brush and half sponge cleaning end.

U.S. Pat. No. 4,802,782 issued on Feb. 7, 1989, to James Scalf describes a cleaning tool for carpets comprising an agitating rake-like brush head and a sponge head on separate connections to a handle ending in a Y-shape. A reservoir of cleaning fluid is attached to the handle and released via a trigger on the handle. The tool is distinguishable for requiring the brush and sponge to be on separate heads.

U.S. Pat. No. 4,961,733 issued on Oct. 9, 1990, to Peter M. Joseph et al. describes a foot cleaning and chemical applicator device comprising a curved handle supporting a small conical sponge at its head and a nylon bristle brush adjacent. The device is distinguishable for requiring the separate locations of the sponge and brush.

U.S. Pat. No. 5,960,509 issued on Oct. 5, 1999, to Chia-Wao Hu describes a multi-functional back brush having three oval cleaning or massaging interchangeable heads. One oval head has a sponge layer topped by a scour pad. The second head has sponge layer covered by a towel cloth. The third head has multiple rolling ball heads on legs. The brush is distinguishable for failing to require a brush and sponge on opposite sides of a base.

U.S. Pat. No. 6,178,581 B1 issued on Jan. 30, 2001, to Larry J. Lewis describes a mop scrubber adapter device for a scrub brush attachment to a butterfly sponge mop at a right angle to the mop. The device is distinguishable for requiring a perpendicular arrangement of the brush and sponge.

U.S. Pat. No. 6,202,246 B1 issued on Mar. 20, 2001, to Laura Boucher describes a multi-purpose scrub mop comprising a triangular shaped head having bristles at the apex and adjacent to the sponge base. The device is distinguishable for requiring the requiring the sponge and brush portions to be arranged adjacent and aligned together.

U.S. Pat. No. 6,289,547 B1 issued on Sep. 18, 2001, to Vinold Narula et al. describes a surgical scrub device comprises a semi-rigid flattened square sponge body having bristles on two opposite edges. The device is distinguishable for requiring the sponge body to have bristles on two opposite edges.

U.K. Patent No. 241,254 published on Oct. 20, 1925, for Hans Hansen describes a cleaning pad for leather comprising a wooden handled stock having a rectangular rubber pad and a wire brush on opposite sides at one end. The device is distinguishable for requiring a rubber pad and a wire brush.

None of the above inventions and patents, taken either singly or in combination, is seen to describe the instant invention as claimed. Thus a two sided toilet brush solving the aforementioned problems is desired.

SUMMARY OF THE INVENTION

The two-sided toilet brush is a cleaning device for cleaning toilet bowls in homes, municipal buildings and in commercial buildings. The brush has a double function in abrasive cleaning with a stiff nylon bristle brush on one side of the convex-shaped head portion and a soft but durable cellulose and the like sponge portion on the opposite concave head side. The head portion has a triangular shape and a small triangular aperture with its apex attached to an angular plastic handle having a slot in its distal end for hanging to dry. The head portion is concave in shape supporting the sponge. The bristle brush portion is inclined at approximately 15 degrees toward the handle. The handle portion has a gentle curvature with its radial axis opposite to the radial axis of the head portion.

Accordingly, it is a principal object of the invention to provide a toilet cleaning implement having a dual cleaning function.

It is another object of the invention to provide a toilet cleaning implement having a stiff bristle portion on a side of a head support.

It is a further object of the invention to provide a toilet cleaning implement having a soft and durable sponge portion on the opposite side of the head support.

Still another object of the invention is to provide a slightly curved handle opposite in curvature to that of the brush.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
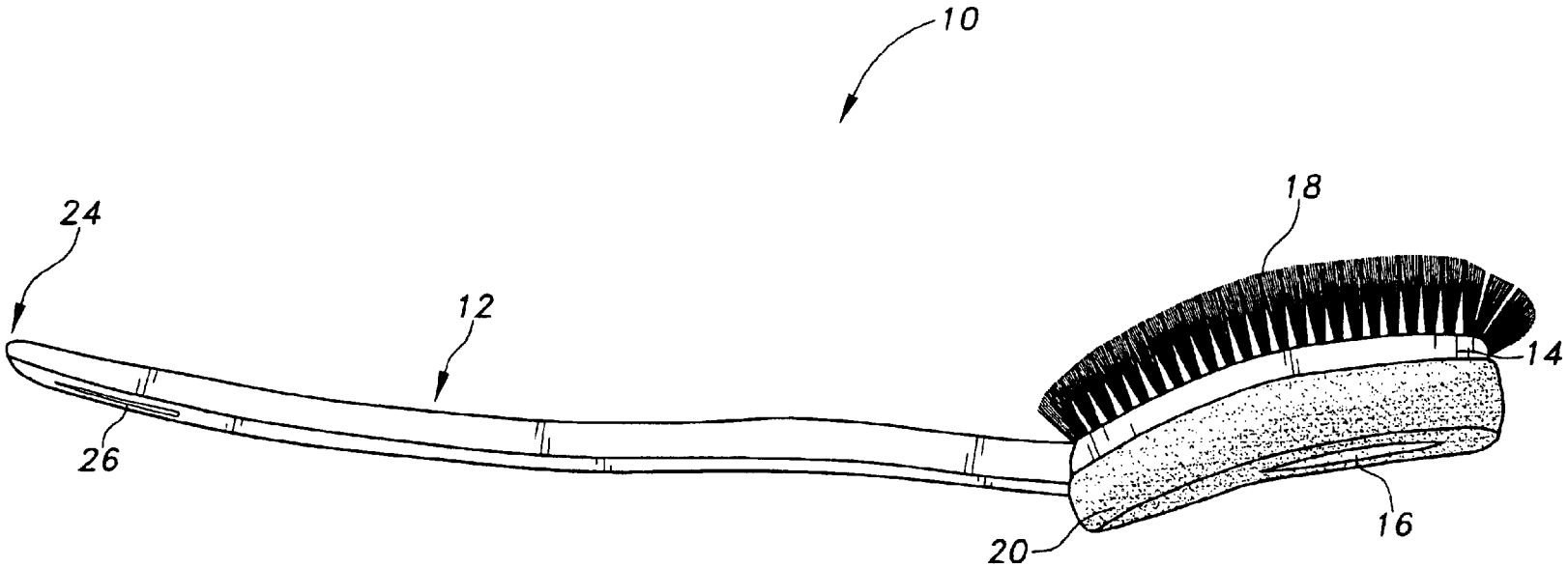
FIG. 1 is side perspective view of a two-sided toilet brush device according to the present invention.
Figure 2:
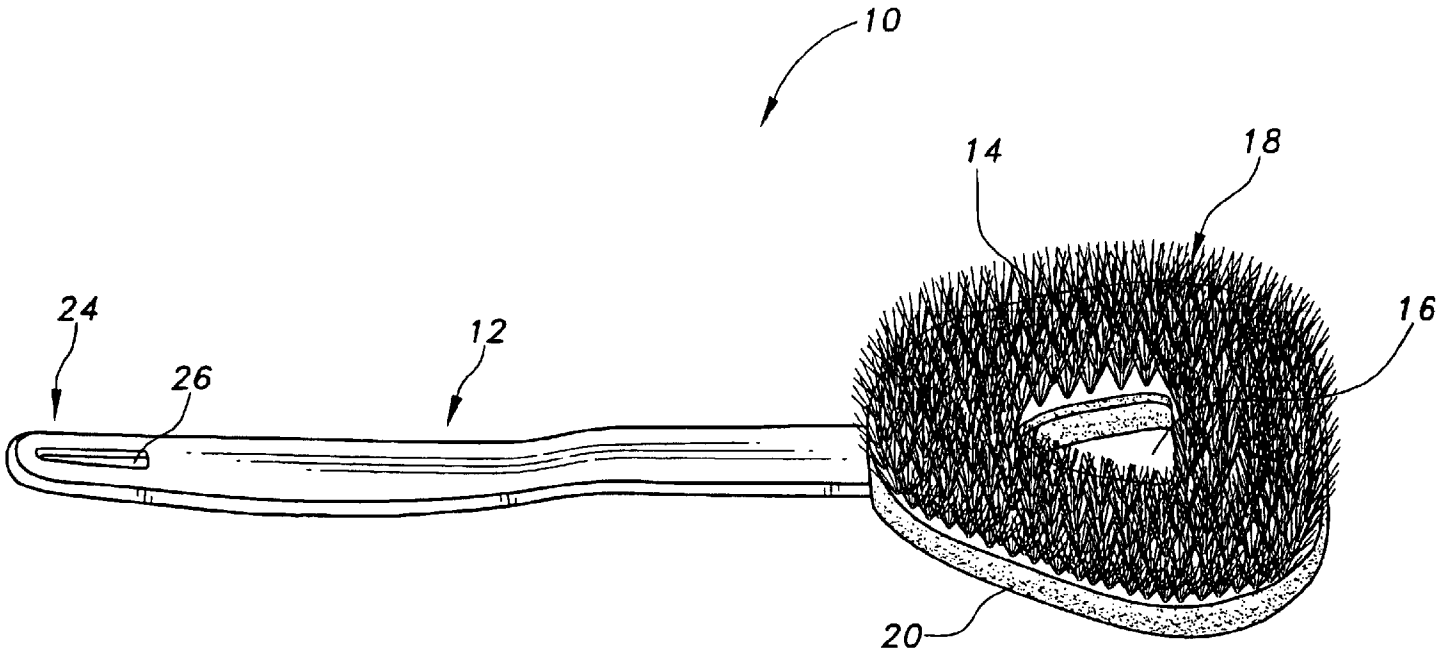
FIG. 2 is a front perspective view of the two-sided toilet brush device showing the bristle brush element according to the present invention.
Figure 3:
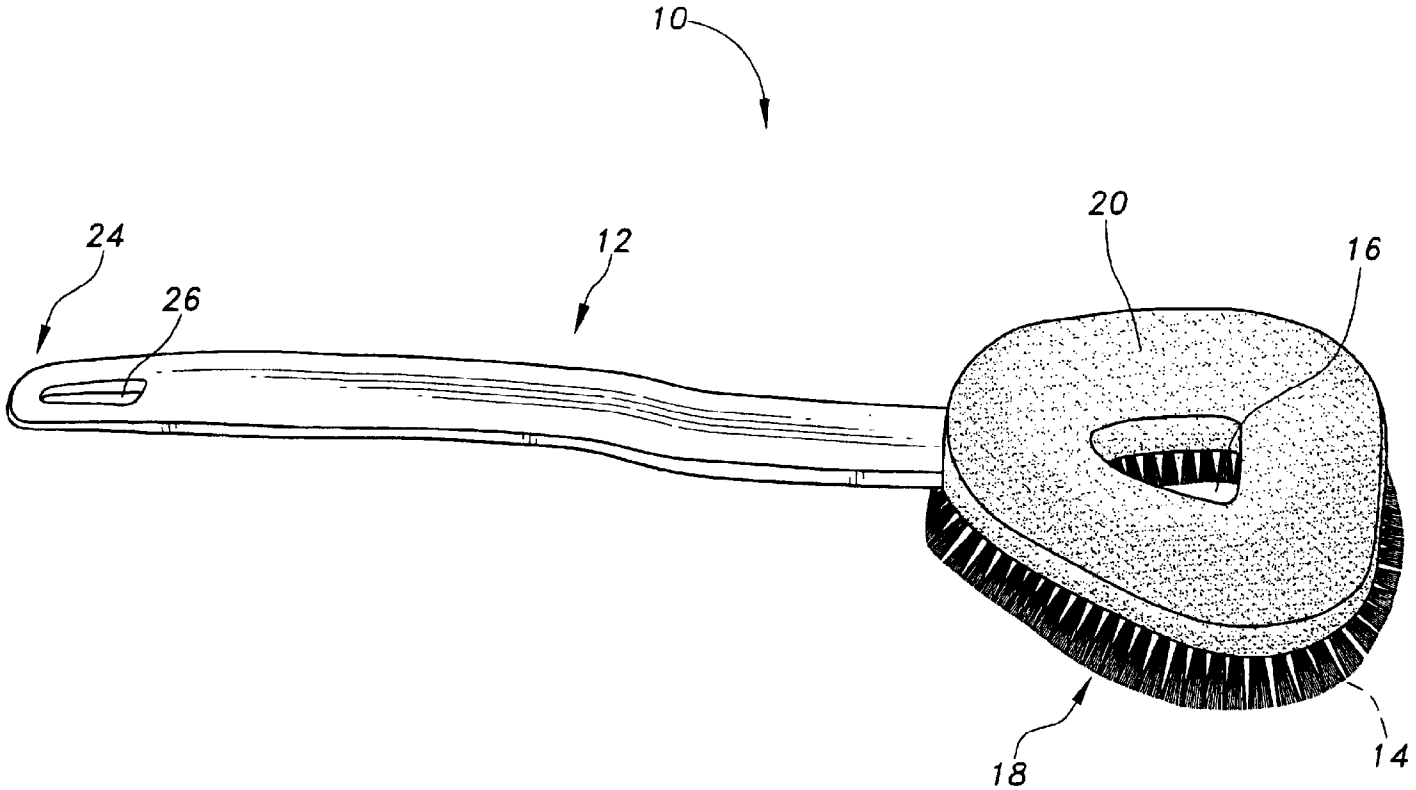
FIG. 3 is a rear perspective view of the two-sided toilet brush device illustrating the sponge brush element according to the present invention.

The present invention is directed in FIGS. 1 to 3 to a two-sided toilet brush device 10 having an increased ergonomic capacity to scrub and clean a toilet. An elongated slightly curved handle 12 has at its head end a triangular shaped base 14 having a triangular aperture 16 supporting a bristle brush 18 on one side and a sponge 20 on the opposite side. The triangular aperture 16 is advantageous in allowing any undesirable debris collected to be rinsed off more effectively to increase the cleaning action of the cleaned brush 18 and/or the sponge 20.

The handle 12 is attached to the base 14 at an included angle of approximately 30 degrees with the bristle brush 18. The handle is slightly curved and enlarged in its mid-section. A slotted aperture 26 is provided for hanging the device 10 to dry or store when not being used.

The bristle brush 18 can have bristles made of nylon, stiff plastic materials, and the like. The base 14 and the handle 12 can also be made of molded nylon and like plastic materials. The sponge 20 can be made of purified cellulose natural sponge and like materials.

Thus, an ergonomic two-sided toilet brush providing a sponge and bristle brush on opposite sides with apertures, and on a curved handle having a hanging aperture has been shown.

It is to be understood that the present invention is not limited to the embodiment described above, but encompasses any and all embodiments within the scope of the following claims.

I claim:

1. A two-sided toilet brush, comprising:

an elongated curved handle having a head end with an aperture;

the head end having a centered aperture;

a bristle brush having a centered aperture positioned on one side of the handle's head a sponge having a centered aperture positioned on an opposite side of the handle's head; and said bristle brush and sponge are identical in shape and size.

2. The two-sided toilet brush according to claim 1, further comprising the bristle brush, sponge and the head end being substantially commensurate in size and shaped triangularly.

3. The two-sided toilet brush according to claim 2, wherein an apex of the triangularly shaped head is attached to one end of the handle.

4. The two-sided toilet brush according to claim 1, wherein the head end is inclined at an angle of approximately 30 degrees to the handle.

5. The two-sided toilet brush according to claim 1, wherein the head end is concave in shape supporting the sponge.

6. The two-sided toilet brush according to claim 1, wherein an elongated aperture is positioned at a handle end opposite to the head end.

7. The two-sided toilet brush according to claim 1, wherein the handle is molded plastic.

8. The two-sided toilet brush according to claim 7, wherein the molded plastic is nylon.

9. The two-sided toilet brush according to claim 1, wherein the bristles are nylon.

10. The two-sided toilet brush according to claim 1, wherein the sponge is cellulose.

11. The two-sided toilet brush according to claim 1, wherein the sponge is a natural sponge.

* * * * *